US006679373B1

(12) United States Patent
Clevenger

(10) Patent No.: US 6,679,373 B1
(45) Date of Patent: Jan. 20, 2004

(54) CONTACT LENS CASES

(76) Inventor: Reed J. Clevenger, 101 Jesnick La., Morrisville, NC (US) 27560

( * ) Notice: Subject to any disclaimer, the term of this patent is extended or adjusted under 35 U.S.C. 154(b) by 0 days.

(21) Appl. No.: 09/666,784

(22) Filed: Sep. 21, 2000

(51) Int. Cl.[7] ..... B65D 85/38
(52) U.S. Cl. ..... 206/5.1; 206/459.5
(58) Field of Search ..... 206/205, 210, 206/5, 5.1, 6, 459.5, 457

(56) References Cited

U.S. PATENT DOCUMENTS

| | | | | |
|---|---|---|---|---|
| 3,037,616 A | * | 6/1962 | Phipps, III | 206/5.1 |
| D272,297 S | | 1/1984 | Thames et al. | |
| D285,744 S | | 9/1986 | Vinot | |
| 4,858,754 A | * | 8/1989 | Wright et al. | 206/5.1 |
| D317,527 S | | 6/1991 | Bonelli | |
| 5,130,011 A | * | 7/1992 | Sage, Jr. | 206/5.1 |
| 5,280,834 A | * | 1/1994 | Berkley | 206/5.1 |
| 5,433,314 A | * | 7/1995 | Lin | 206/5.1 |
| 5,452,792 A | * | 9/1995 | Zautke et al. | 206/5.1 |
| D368,368 S | | 4/1996 | Merritt | |

* cited by examiner

*Primary Examiner*—Jim Foster
(74) *Attorney, Agent, or Firm*—Glasgow Law Firm, PLLC

(57) ABSTRACT

A contact lens case containing design asymmetries sufficient to allow the ready distinction of the left and right wells by touch alone, but also containing optical asymmetries sufficient to aid in the distinction of left and right wells under poor vision conditions. Asymrnetries include large tactile asymmetries, such as curvature of the case; small tactile asymmetries, such as raised symbols; and grossly visible asymmetries, such as different well lid designs. The present invention also provides structural enhancements that improve the durability of the case and facilitate lens removal and insertion. Furthermore, the cases are manufactured in a variety of colors and designs, allowing the wearer to customize the cases in order to readily distinguish between different cases and, consequently, between different pairs of lenses.

30 Claims, 9 Drawing Sheets

FIG. 6
FIG. 6a
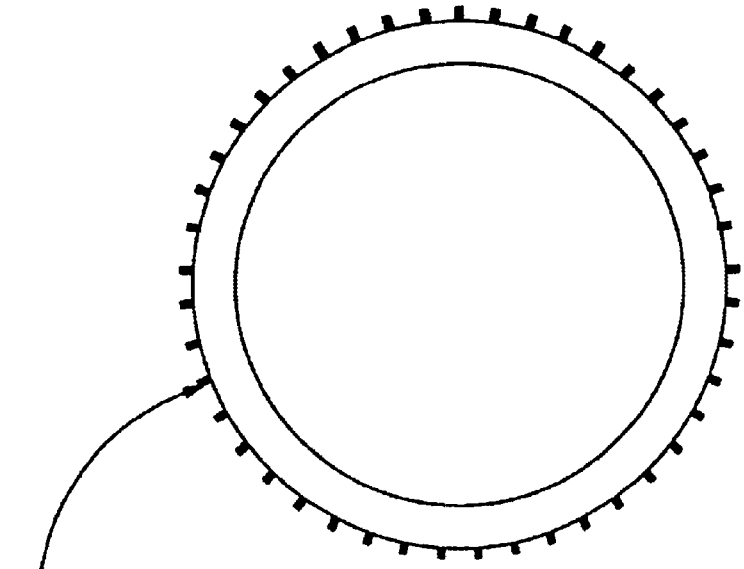
624
36
FIG. 6b
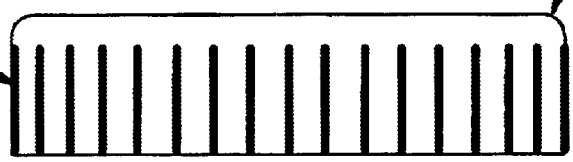
FIG. 6c
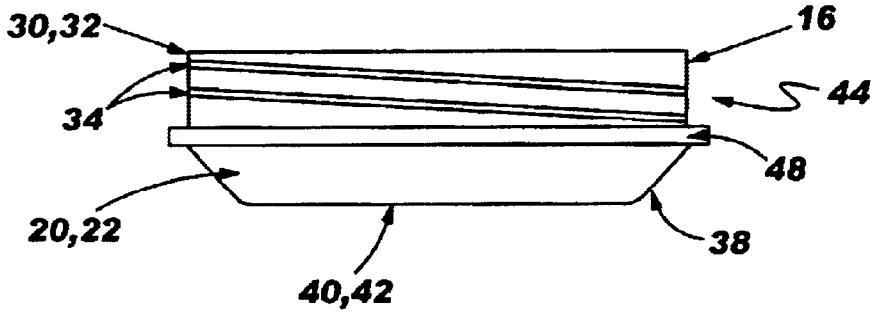

CONTACT LENS CASES

BACKGROUND OF THE INVENTION (1) Field of the Invention

The present invention relates generally to contact lens cases and, more particularly, to contact lens cases having asymmetric properties for facilitating proper orientation of the case for accurate lens removal and insertion. Furthermore, the cases are manufactured in a variety of colors and designs, allowing the wearer to customize the cases in order to readily distinguish between different cases and, consequently, between different pairs of lenses.

(2) Description of the Prior Art

Contact lens cases are ubiquitous in modern society and many improvements have been made since their first invention.

Generally in the relevant art, the contact lens cases were marked in a manner that would allow the wearer to distinguish the left lens from the right lens because of the possibility that the wearer might need different lenses for each eye. Alternately, persons may not have different prescriptions for each eye, but may simply have a desire to keep the left and right lenses separated. Usually, the individual wells holding the lenses were marked with a visual marking of an L (for left) and an R (for right). Other symbols were doubtlessly also used, depending in part on the language and alphabet of the region in which the case would be used. The letters or symbols may also have been printed in relief to provide the contact lens case user with some indication of left and right sides of the case. No known improvements have been made on this convention.

Although these case characteristics allowed most wearers to easily distinguish the case wells under normal circumstances, wearers with severely impaired vision or wearers in areas of bad lighting may have found the task difficult. Wearers of contact lenses having poor touch or tactile sensitivity would be particularly disadvantaged in such a situation and would doubtlessly have to determine the proper lens for a particular eye by trial and error-insertion of a lens into an eye to determine if it properly corrects that eye's vision. Inserting and removing contact lenses can be a difficult task even under favorable conditions, and often lenses are dropped.

Contact lenses are small and transparent by design; these are properties that make them difficult to find when dropped. Dropping lenses under difficult circumstances can therefore lead to the loss of a lens. Furthermore, the advent and popularity of colored and/or designed or decorated lenses for cosmetic apparent alteration of eye color also requires quick recognition of the type of lens included within a given case for holding contact lenses. Insertion of the wrong lens type or style into the incorrect eye necessitates removal and reinsertion of the lens into the correct eye. These factors increase the chance of dropping and losing a lens. Again, dropping a lens often results in the loss of or damage to the lens.

In addition to these problems, persons with only minor vision differences between eyes may not be able to readily determine if the lenses are inserted into the proper eye. Also, some persons require different vision-correction power for each eye. In such circumstances, the person, upon arrival in better lighting conditions or after a period of time has passed since insertion, may notice the slight aberration of their vision. This annoyance may necessitate removal and reinsertion of the lenses into the correct eyes. Having to stop unexpectedly to exchange lenses between eyes may increase the possibility of contamination or damage to the lens or eye because the wearer may be in a hurry at the moment. In addition, stopping one's activity to correct this mistake is a definite annoyance and may even be a source of embarrassment if one has to explain to bystanders the motive for exchanging the lenses between eyes.

Traditionally, prior art has consistently used symmetrical cases to house or contain contact lenses. A few ornamental exceptions exist without any functional benefit being derived from the ornamental shape. Furthermore, complex ornamental designs of contact lens cases as in prior art compromise the structural integrity and fitness of use of the contact lens cases under normal, daily use. The shapes were purely decorative and the ornamentation often resulted in a structurally weak case with less-than-desirable compensatory characteristics, such as flip-top lids. In others, the non-symmetry was slight and difficult to distinguish visually or tactilely. As stated, these cases were typically structurally weak and easily broken. Thus, there remains a need for a durable case that will allow the contact lens wearer to easily distinguish the orientation of the case and easily remove and replace lenses into the case.

Additionally, the shapes, colors, and designs of contact lenses have recently expanded greatly due to advances in lens manufacturing technology and a demand by users for more creative and expressive lenses. This growth in the variety of lenses available has created a greater need for contact lens users to more easily distinguish lens pairs. This need can be satisfied by modification of case properties, including using different case colors, using customized well lids, and/or using transparent well lids, to make the cases or lens pairs readily distinguishable.

Therefore, a need exists to improve on the current art by allowing the wearer to more easily distinguish the left and right wells by incorporating more advanced physical, optical, and tactile qualities into the design, shape, and structure of the case.

SUMMARY OF THE INVENTION

The present invention provides a contact lens case for allowing the wearer to more easily distinguish the left and right wells by incorporating more advanced physical, optical, and tactile qualities into the design, shape, and structure of the case. As such, it is within the scope of the present invention is to provide contact lens cases having structural characteristics that improve the durability of the case and/or facilitate the handling of the case and/or lens. Also, it is within the scope of the invention to incorporate structural characteristics that make individual cases readily distinguishable or that allow the ready incorporation into the case of different ornamental designs such that individual cases can be made to be readily distinguishable or easily customizable.

It is an object of the present invention to provide a contact lens case that allows the user to distinguish the left and right wells of the case for quickly identifying which well from which to remove or to insert the respective and corresponding contact lens. Thus, one aspect of the present invention includes incorporating several physical, tactile, and/or optical asymmetries along one or both horizontal axes of the case.

Another object of the present invention is to provide a contact lens case having improved structural stability for durability in daily use over time. As such, one aspect of the present invention is to provide a contact lens case that incorporates structural improvements that allow the wearer to more easily retrieve and/or replace the lenses from/in the case without damage or breakage to the case.

A final scope of the invention is to make individual cases customizable and/or readily distinguishable. To this end, the cases are designed such that structural characteristics are incorporated that will allow the ready incorporation into the case of different ornamental designs or characteristics such that individual cases can be made to be readily distinguishable or easily customizable.

BRIEF DESCRIPTION OF DRAWINGS

FIGS. 6*a*, 6*b* and 6*c* a side view of a section of an embodiment according to the present invention.

DEFINITIONS

Figure 1:
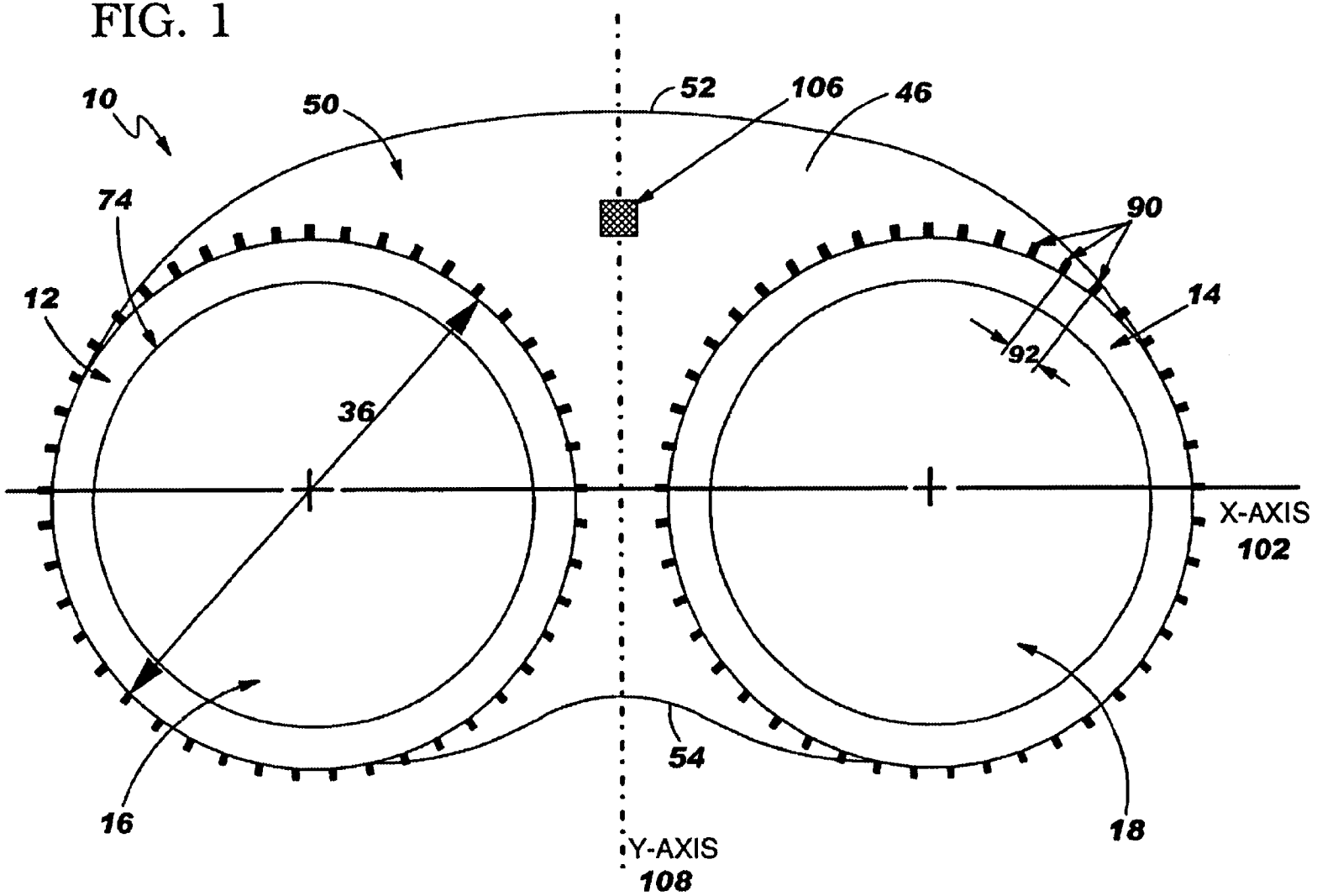
FIG. 1 shows a top view of a preferred embodiment according to the present invention.

For the purposes of improved clarity of the detailed description of the invention and preferred embodiments thereof, the following definitions are set forth but are not intended to otherwise limit the terms as understood in the art.

"Opening position" is intended to describe the position of the case in which it is upright in front of the opener with the well containing the left lens (left well) towards the left of the opener and the well containing the right lens (right well) toward the right of the opener.

"X-axis" is intended to describe the axis of the case that runs from left to right when the case is held in opening position in front of the wearer.

"Y-axis" is intended to describe the axis of the case that runs from front to back when the case is held in opening position in front of the wearer.

"Z-axis" is intended to describe the axis of the case that runs from top to bottom when the case is held in opening position in front of the wearer.

DETAILED DESCRIPTION OF THE PREFERRED EMBODIMENT

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. Referring now to the drawings in general, the illustrations are for the purpose of describing a preferred embodiment of the invention and are not intended to limit the invention thereto.

Figure 7:
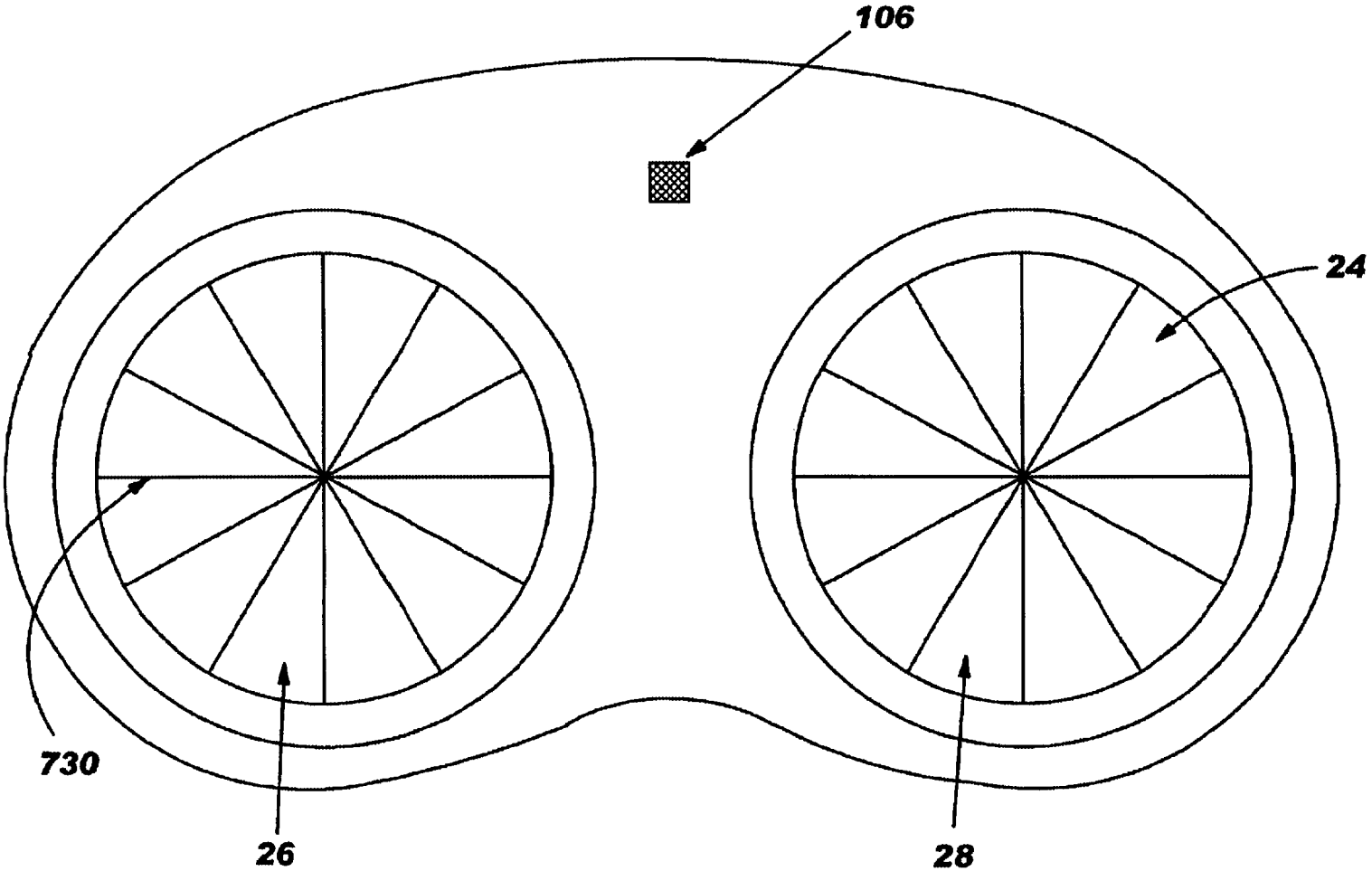
FIG. 7 shows a top inside view of an embodiment according to the present invention.

In a preferred embodiment of the invention, generally referenced 10, a contact lens case 10 is shown that includes at least two independent containers 12 and 14, cylindrically-shaped at respective top interiors 16 and 18, as best shown in FIGS. 6*a*, 6*b* and 6*c*, and converging at respective bottom interiors 20 and 22, in a gradual arc 24, as best shown in FIG. 7, that may also be patterned, e.g. beveled, spiral, or other 3-dimensional pattern, to form two independent well-shaped cavities 26 and 28, respectively. The respective exteriors 30, 32 of the wells are cylindrical and threaded at the top region 34 in order to accept a screw-type lid 36, then tapered conically 38 towards flat bottoms 40, 42 to form the case base 44, as shown in FIGS. 6*a*, 6*b* and 6*c*. Significantly, the screw-type lids include a threaded top region 34 having at least 2.5 turns, preferably 3.5 turns. The at least 2.5 turns on each threaded top region ensures secured lid placement and sealed closure when the lids are screwed onto the respective case wells.

Figure 4:
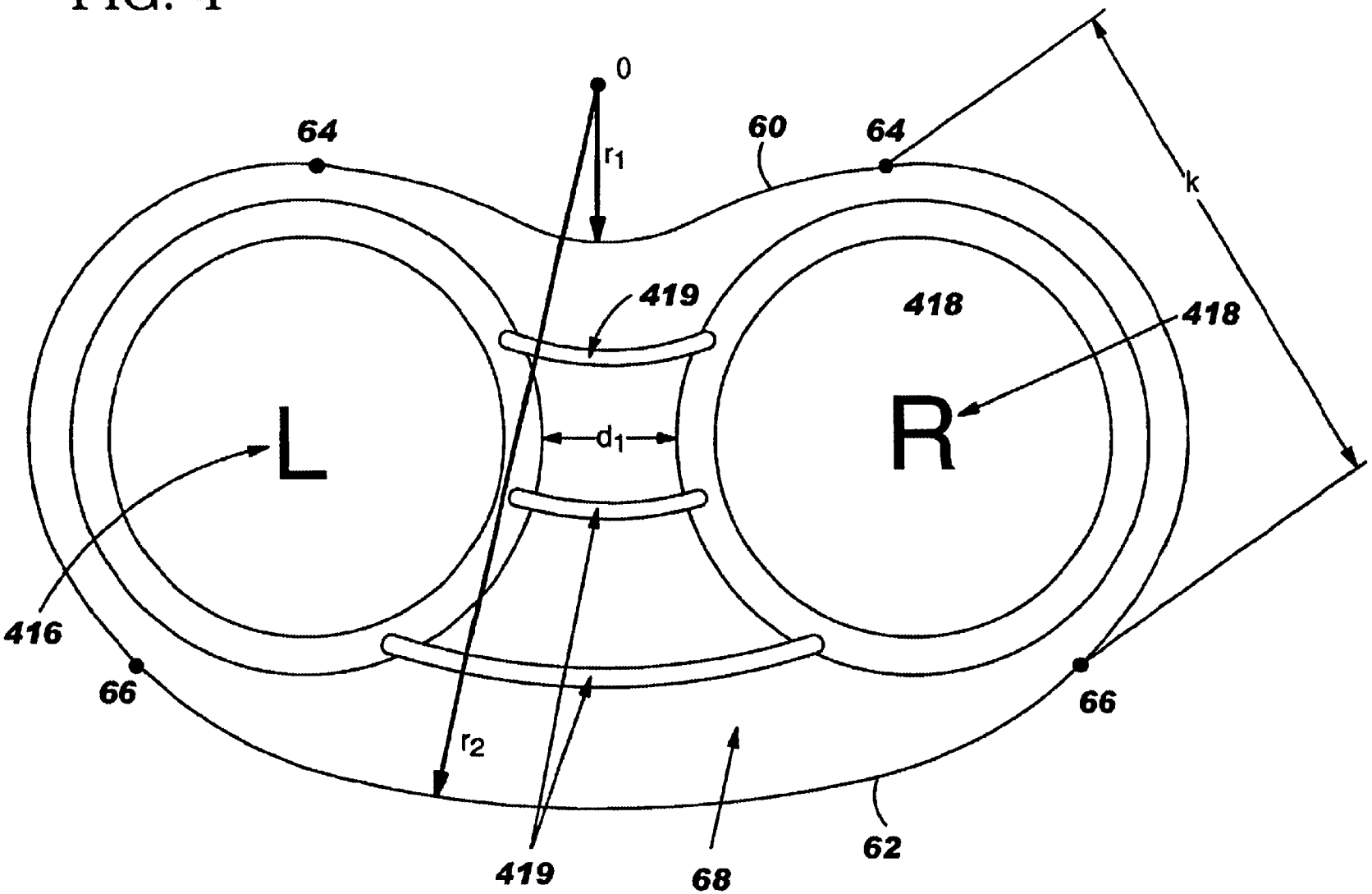
FIG. 4 shows a bottom view of an embodiment according to the present invention.

The wells 26, 28 are connected by a bridge region 46 at the exterior convergence 48 of the upper cylindrical portion 30, 32 and the bottom conical portions 38 of the wells, as best shown in FIGS. 1 and 4. This bridge region 46 is in the form of an arcuate plane 50 formed by the area 55 between two parallel arcs 52, 54, respectively. The area 55 between the arcs is defined by the distance k between two parallel arcs which are semicircles 56, 58 of two circles having the same origin O and having radii r and $r_1$, wherein $k=r-r_1$. The distance k is also the approximate diameter of a case lid 36. The arcuate plane connects the wells beginning in the region where the rear boundary arc 60 of the arcuate plane meets the wells, which are posterior tangents 64, and extending to the region where the front boundary arc 62 of the arcuate plane meets the wells at front tangents 66.

In a preferred embodiment, the wells and arcuate plane together form a base 68 that can be of a variety of colors to facilitate distinction between cases. This color-coded distinction advantageously facilitates distinction between contact lens cases housing different types of contact lenses. Furthermore, the case in the preferred embodiment includes a high polish finish. Importantly, this high polish finish prevents the accumulation of dust and other particulate matter that might contaminate or otherwise negatively impact the sterility of the lenses enclosed within the case wells. Also importantly and surprisingly, the ridged regions on the exterior circumference of each of the lids to facilitate lid removal and closure include ridges 90 at a spaced apart distance equal to at least the width dimension 92 of each of the ridges. Preferably, the spaced apart distance is equal to at least about 1.5 to 2.0 times the width dimension of each of the ridges. This spaced apart distance is also important in preventing the accumulation of dust and other particulate matter that might contaminate or otherwise negatively impact the sterility of the lenses enclosed within the case wells.

Figure 2A:
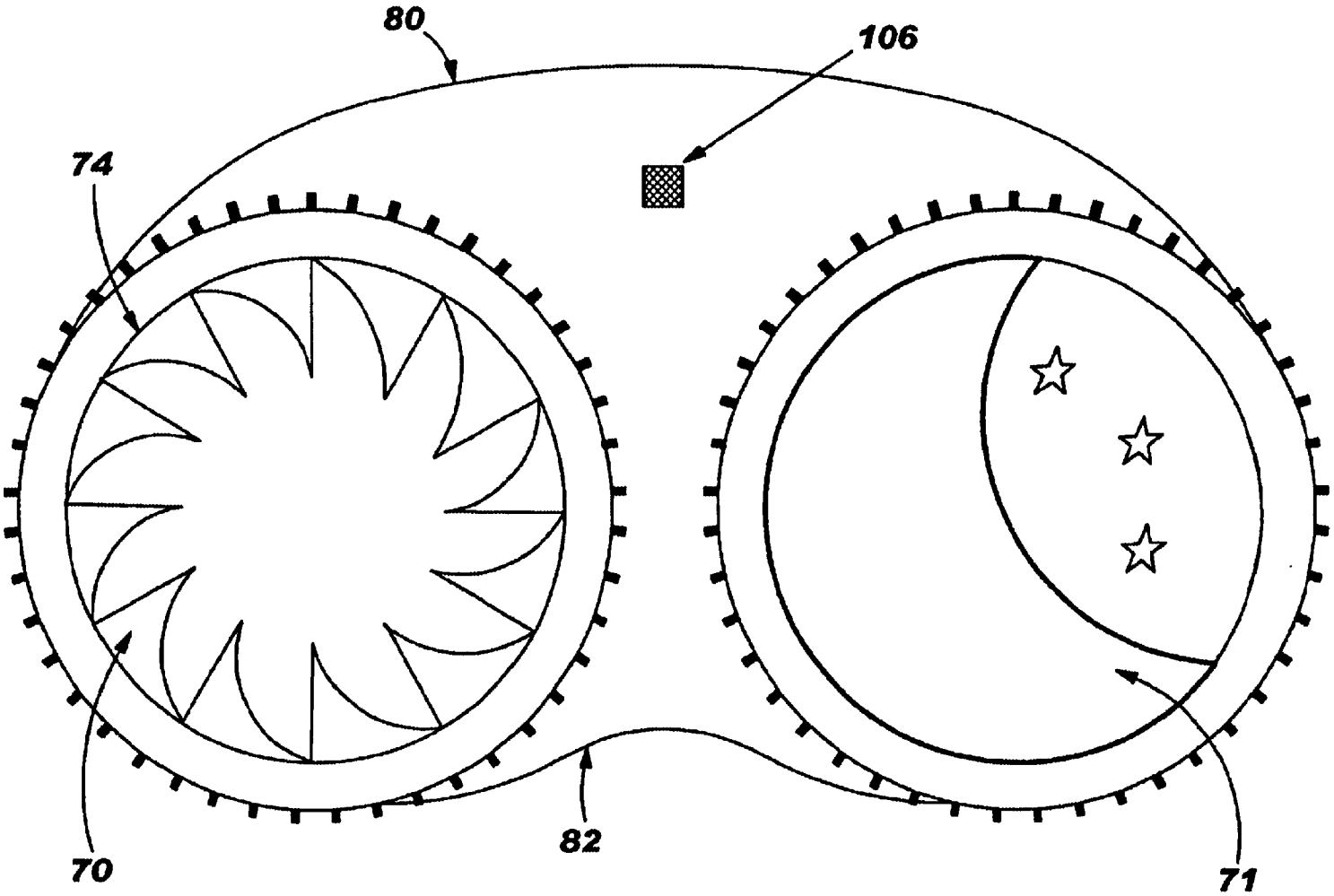
FIGS. 2A and 2B show top views of an alternative embodiment according to the present invention.
Figure 2B:
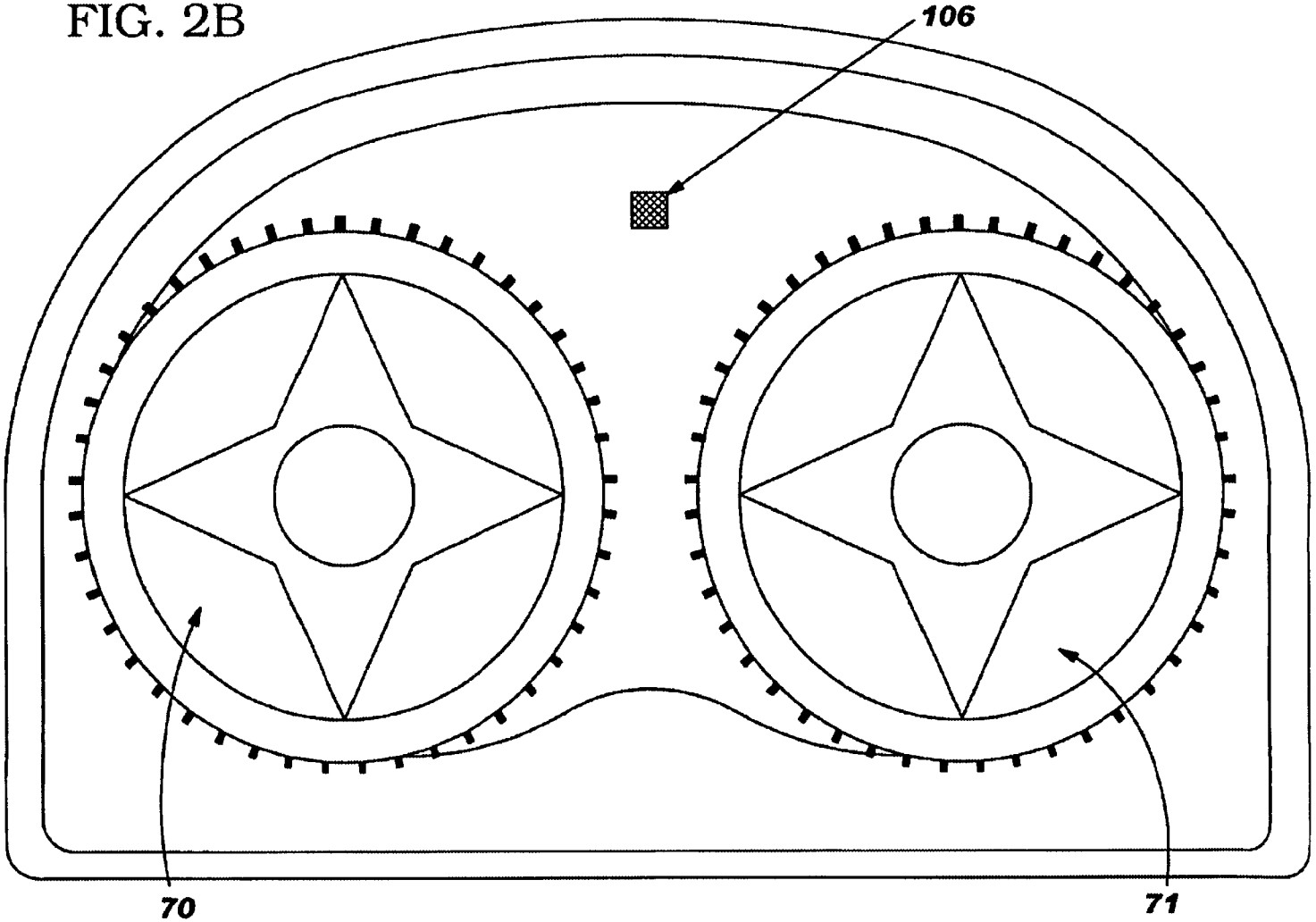

As set forth in the foregoing, the wells are covered with screw-type lids designed to form a waterproof seal (not shown) with the top of the wells. In addition, these lids are designed to accommodate adhesive stickers 70, 71 as shown in FIGS. 2A, 2B on their upper exterior surface 72 such that the cases are customizable in a variety of patterns. Notably, the upper exterior surface 72 includes a lip 74 that is approximately equal to the thickness of the sticker 70 and constructed and configured such that when the sticker is applied to the upper exterior surface the sticker does not protrude above the plane 76 established by the exterior surface lip. Alternately, the lids may be sufficiently transparent or translucent to allow the user to identify the contents directly.

The arcuate plane, formed by the two parallel arcs of, is designed such that the case holder can readily discern the front 80 and rear edges 82 of the case. A shape of two parallel arcs is more advantageous to the user for the task of orientation than other designs, for example, designs wherein the bridge has no symmetry whatsoever or designs wherein the bridge is formed by the area between two opposing arcs. In this latter configuration, it is necessary for the holder to be able to distinguish between the orientation of the curvature of the arcs and the degree of curvature of the anterior and posterior arcs as with prior art cases. Determining the degree of curvature of the arcs may be difficult for persons with poor tactile abilities, large digits, bandaged fingers, or prostheses. Therefore, elimination of this step in the task of case-orientation is a definite benefit. This difficulty is eliminated with the present invention.

In preferred embodiments, the case incorporates one or more of the following characteristics either separately or in combination.

Figure 3:
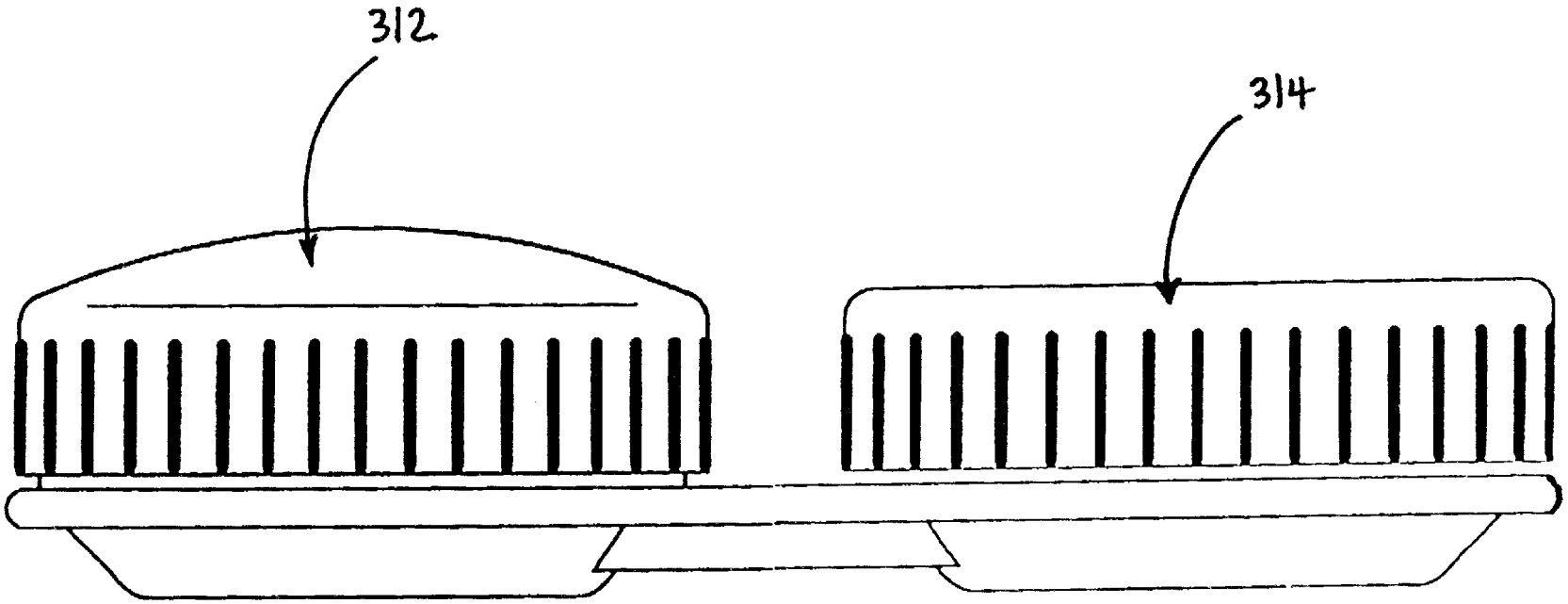
FIG. 3 shows a side view of an embodiment according to the present invention.
Figure 5A:
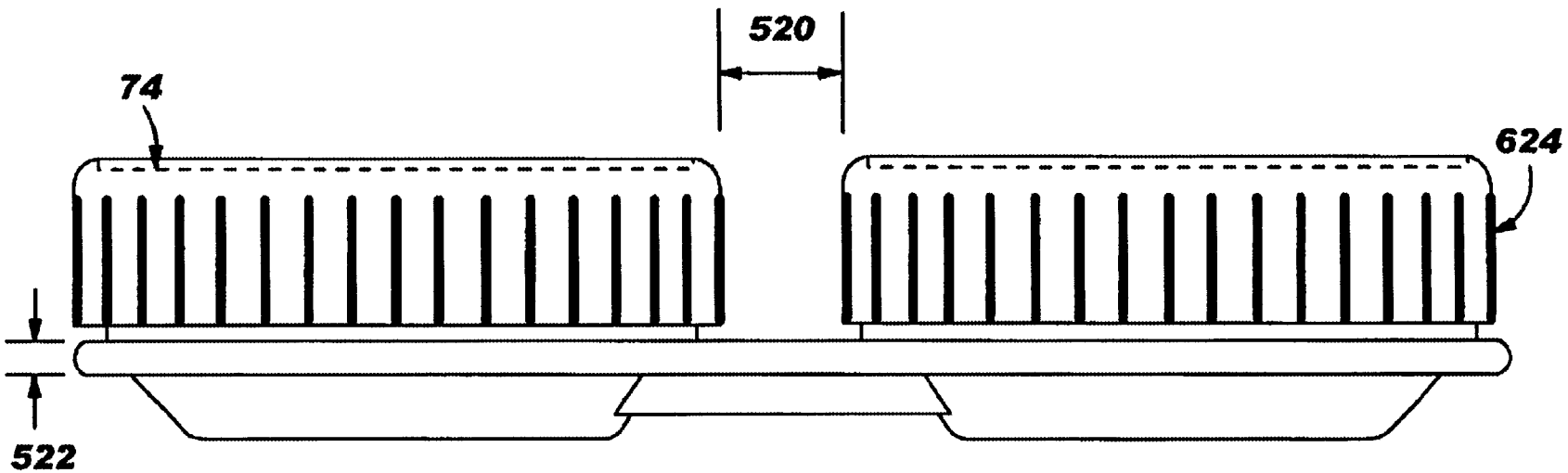
FIGS. 5A and 5B show side views of an embodiment according to the present invention.
Figure 5B:
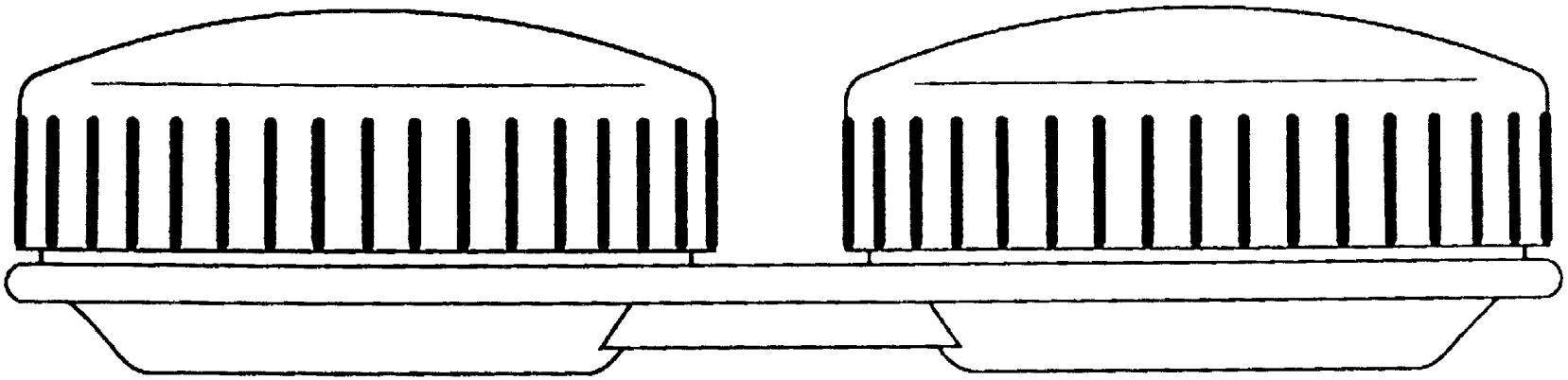

The case orientation by the user is improved and facilitated by a variety of characteristics, primarily asymmetry of case configuration and construction serves as the predominant orientation characteristic. An asymmetry along the x-axis 102 of the case is advantageously incorporated as an aid for case orientation. For example, this asymmetry can be a curvature in the case, such as is shown in FIG. 1, and/or the incorporation of a distinguishing symbol 106 on one side of the axis. An asymmetry along the y-axis 108 may also advantageously be incorporated as an aid for case-orientation. This asymmetry, as best shown in FIG. 2A, is provided by dissimilar optical designs 70, 71 on the lids of the left and right wells. Also, the shape or size of the lids may be different, allowing the wearer to distinguish the left and right cases by touch as well as sight. For example, as best shown in FIG. 3, one lid may be domed 312, whereas the other may be flat 314. Alternately, both lids may be flat, as shown in FIG. 5A, or domed, FIG. 5B. Regardless of the shape or size of the lids, they are interchangeable with respect to the wells to allow for easier production of the complete case line and rapid adaptability of the lids to changing buying forecasts or patterns. Also, as shown in FIG. 4, the letters L (416) and R (418) may be printed in relief on the bottom of the wells such that when the wearer holds these in the legible orientation, the case can be moved to the opening position by simply rotating the case around the x-axis.

Structural characteristics that improve the durability of the case and/or facilitate the handling of the case and/or lens may also be incorporated into the case. Such improvements include a multiplicity of ridges, preferably triple ridges 419, that follow the curve of the case and connect the wells in order to provide strength and stability such that the case will not snap or break. These ridges may be rounded for handling comfort and of sufficient thickness and depth to impart adequate strength and rigidity to the case. Another improvement is the incorporation of sufficient spacing 520 between lids to facilitate their removal and replacement. Base thickness 522 may also be such as to provide adequate support, strength, and stability. Ridged-edged lids 624 to prevent slippage when opening or closing the well may also be included. Lipped lids (not shown) and screw-on lids to facilitate waterproof closure of the wells are definite benefits that may be included in case design. Wells that are patterned 730 on the interior, e.g., faceted, spiraled, ridged, or the like, wide, and/or deep in order to facilitate removal of the lenses from the wells are other characteristics that may be included into the design of the case.

Structural characteristics that make individual cases customizable and/or readily distinguishable may also be incorporated into the case. Lids may be provided that incorporate recessed top exteriors to accommodate an adhesive in such a fashion that the top of the adhesive is sufficiently flush with the bordering top of the lid such that the edge of the adhesive cannot be lifted from the lid by simple contact. This characteristic allows for a variety of designs to be adhered onto the well lids in an aesthetically pleasing manner. These stickers may be in a variety of designs including, but not limited to, product brands, logos, and custom designs. Using adhesive stickers also allows the user to easily change case design should they need to or so desire. Additionally, using adhesive stickers allow the manufacturer to manufacture "blank" cases and then decorate them with appropriate adhesives as required. This flexibility in design facilitates meeting forecasts and/or buying patterns and allows a more rapid change in production of individual designs. A final characteristic that can be used to customize cases or make cases readily distinguishable is case color. For example, a case color may be selected that matches or complements the lens color.

Certain modifications and improvements will occur to those skilled in the art upon a reading of the foregoing description. All modifications and improvements have been deleted herein for the sake of conciseness and readability but are properly within the scope of the following claims.

I claim:

1. A case for containing contact lenses comprising at least two, open-topped, independent containers that form wells, substantially cylindrically-shaped at the top interiors and converging at the bottom interiors in a gradual arc to form two independent well-shaped cavities in which the exteriors of the wells are cylindrical and threaded at the top in order to accept a screw-type lid, then tapered conically towards flat bottoms to form the case base and additionally connected by a plane near the exterior convergence of the upper cylindrical portion and the bottom conical portions of the wells and containing an asymmetry along one or more of the horizontal axes in order to more readily identify the proper orientation of the case for the purpose of easily distinguishing the left and right wells in order that the lens wearer may forego mistakenly switching the left and right lenses, wherein the asymmetry is found about a y-axis of the case, and wherein said y-axis asymmetry is provided by letters L and R printed on the bottom of the wells such that when the wearer holds these in a legible orientation, the case can be moved to an opening position by simply rotating the case around an x-axis.

2. The case according to claim 1 further including structural reinforcement in the connecting plane of the case for improving the durability and strength of the case.

3. The case according to claim 2 wherein the structural reinforcement includes at least one downwardly protruding ridge formed integrally with the connecting plane.

4. The case according to claim 2 wherein the structural reinforcement includes three downwardly protruding ridges formed integrally with the connecting plane.

5. The case according to claim 2 wherein the structural reinforcement includes a base thickness sufficient to provide adequate support, strength, and stability.

6. The case according to claim 1 wherein the asymmetry along the y-axis is provided by dissimilar optical designs on the lids of the left and right wells.

7. The case according to claim 1 wherein the asymmetry along the y-axis is provided by dissimilarities in the shapes of the lids.

8. The case according to claim 7 wherein the dissimilarity of the lids is due to one lid being domed.

9. The case according to claim 1 wherein the asymmetry along the y-axis is provided by dissimilarities in the sizes of the lids.

10. The case according to claim 1 wherein top exteriors of the lids are recessed to accommodate an adhesive design in such a fashion that a top of the adhesive design is sufficiently flush with a bordering top of the lid such that edges of the adhesive cannot be lifted from the lid by simple contact.

11. The case according to claim 1 further including predetermined case coloration selected for ease of differentiation between other non-colored and differently colored cases.

12. A case for containing contact lenses comprising at least two, open-topped, independent containers, with corresponding lids, the containers being substantially cylindrically-shaped at the top interiors and converging at the bottom interiors in a gradual arc to form two independent well-shaped cavities or wells, the wells being connected by a connecting plane having a curvature, in which the exteriors of the wells are substantially cylindrical, then tapered conically towards flat bottoms to form the case base and additionally connected by a plane near the exterior convergence of the upper cylindrical portion and the bottom conical portions of the wells and containing an asymmetry along one or more of the horizontal axes in order to more readily identify the proper orientation of the case for the purpose of easily distinguishing the left and right wells in order that the lens wearer may forego mistakenly switching the left and right lenses, wherein the asymmetry is found about an x-axis of the case, further including structural reinforcement in the connecting plane of the case for improving the durability and strength of the case, wherein the structural reinforcement includes three downwardly protruding ridges formed integrally with the connecting plane, wherein the ridges arc parallel.

13. The case according to claim 12 wherein the curvature in the case is produced by an arcuate plane that connects the wells.

14. The case according to claim 12 wherein the asymmetry along the x-axis is a distinguishing symbol on one side of the x-axis of the case.

15. The case according to claim 12 wherein the ridges are parallel and follow the curvature of the connecting plane.

16. The case according to claim 12 further including structural features for facilitating the handling of the case and lens.

17. The case according to claim 16 wherein the handling facilitators include sufficient spacing between lids to facilitate their removal and replacement.

18. The case according to claim 16 wherein the handling facilitators include ridged-edged lids to prevent slippage when opening or closing the well.

19. The case according to claim 18 wherein the ridged-edged lids include a plurality of spaced apart ridges that are spaced apart at a distance equal to at least the width dimension of each ridge.

20. The case according to claim 16 wherein the case includes a high polish surface finish for prevention of the accumulation of contaminants on the case.

21. The case according to claim 16 wherein the handling facilitators include lipped lids to facilitate waterproof closure of the wells.

22. The case according to claim 16 wherein the handling facilitators include screw-on lids to match a corresponding threaded portion near a top portion of the wells to facilitate waterproof closure of the wells.

23. The case according to claim 22 wherein the lids are connected to the wells via a threaded region having at least 2.5 turns.

24. The case according to claim 16 wherein the handling facilitators include patterned wells to facilitate removal of the lenses from the wells.

25. The case according to claim 24 wherein the pattern of the wells is ridged.

26. The case according to claim 24 wherein the pattern of the wells is spiraled.

27. A case for containing contact lenses including two, open-topped, independent containers, appropriately spaced for ease of lid opening and substantially cylindrically-shaped at the top interiors and converging at the bottom interiors in a gradual arc that is also ridged to form two independent well-shaped cavities in which the exteriors of the wells are cylindrical, threaded at the top, and of a design to accept screw-type, ridged-edged, internally-lipped lids with dissimilar external superior, recessed, adhesive designs, then tapered conically towards flat bottoms to form the case base and additionally connected near the exterior convergence of the upper cylindrical portion and the bottom conical portions of the wells by an arcuate plane that has a design on the upper forward part, is of sufficient thickness to provide adequate support, strength, and stability, and is reinforced with three downwardly protruding ridges formed integrally with the arcuate plane such that the ridges are parallel, evenly spaced, and follow the curvature of the arcuate plane.

28. A case for containing contact lenses including at least two internally-ridged, screw-top wells with corresponding, removable lids, the wells being connected by an arcuate plane, the arcuate plane having a face side and a back side, the face side being positioned to contact each of the lids and the back side of the plane being reinforced with three descending, parallel and spaced-apart ribs, thereby providing asymmetries of the case that are sufficient to allow the ready distinction of the left and right wells by touch alone while providing improved durability of the case and facilitate lens removal from and insertion into the case.

29. The case according to claim 28 wherein the lids have dissimilar markings.

30. The case according to claim 28 wherein the lids are dome-shaped.

* * * * *